US012702242B2

(12) United States Patent
Glavin

(10) Patent No.: US 12,702,242 B2
(45) Date of Patent: Aug. 11, 2026

(54) QUILT WITH FOOTBOX

(71) Applicant: ZENBIVY LLC, Spokane, WA (US)

(72) Inventor: Michael Glavin, Spokane, WA (US)

(73) Assignee: Zenbivy, LLC, Spokane, WA (US)

( * ) Notice: Subject to any disclaimer, the term of this patent is extended or adjusted under 35 U.S.C. 154(b) by 211 days.

(21) Appl. No.: 18/471,490

(22) Filed: Sep. 21, 2023

(65) Prior Publication Data

US 2024/0099484 A1 Mar. 28, 2024

Related U.S. Application Data

(60) Provisional application No. 63/376,895, filed on Sep. 23, 2022.

(51) Int. Cl.
*A47G 9/08* (2006.01)
*A47G 9/02* (2006.01)
*A47G 9/06* (2006.01)

(52) U.S. Cl.
CPC ..... *A47G 9/086* (2013.01); *A47G 9/0207* (2013.01); *A47G 9/066* (2013.01)

(58) Field of Classification Search
CPC . A47G 9/086; A47G 9/08; A47G 9/02; A47G 9/0207; A47G 9/0223; A47G 9/0238; A47G 9/066; A47G 9/06
USPC ..... 5/413 R, 502, 496, 500
See application file for complete search history.

(56) References Cited

U.S. PATENT DOCUMENTS 906,551 A * 12/1908 Newman ..... A41B 13/06 2/69.5
2,832,967 A * 5/1958 Sobel ..... A47G 9/0207 2/69.5
4,142,264 A 3/1979 Whiting
4,217,662 A * 8/1980 Buchman ..... A47G 9/066 2/69.5
5,887,299 A 3/1999 Phillips
7,178,185 B1 * 2/2007 Nattler ..... A41D 15/04 2/84
10,765,240 B2 9/2020 Glavin
2009/0025118 A1 1/2009 Pothier
2020/0022512 A1 1/2020 Glavin
2024/0099484 A1 * 3/2024 Glavin ..... A47G 9/0207

FOREIGN PATENT DOCUMENTS

AU 2023233199 A1 * 4/2024 ..... A47G 9/0207
AU 2019309776 B2 * 11/2024 ..... A47G 9/0207
EP 4342338 A1 * 3/2024 ..... A47G 9/0207
WO WO-2020023274 A1 * 1/2020 ..... A47G 9/0207

OTHER PUBLICATIONS

European Search Report received for EP23199084, dated Feb. 12, 2024; 9 pps.

* cited by examiner

*Primary Examiner* — Robert G Santos
(74) *Attorney, Agent, or Firm* — Armstrong Teasdale LLP

(57) ABSTRACT

A quilt has an inner surface, an outer surface opposed to the inner surface, a top edge, a bottom edge, a first lateral edge, and a second lateral edge spaced from the first lateral edge. The quilt includes a first set of one or more lateral fastener elements extending along the first lateral edge and a second set of one or more lateral fastener elements extending along the second lateral edge adapted for selective engagement and disengagement with each other. A bottom corner of the first lateral edge is folded over a bottom corner of the second lateral edge to form the footbox.

20 Claims, 6 Drawing Sheets

QUILT WITH FOOTBOX

CROSS-REFERENCE TO RELATED APPLICATION

This application claims priority to U.S. Provisional Patent Application No. 63/376,895, filed Sep. 23, 2022, which is hereby incorporated by reference in its entirety.

FIELD OF THE INVENTION

The field of the present disclosure relates to quilts and, in particular, disclosed herein are various quilts with a footbox wherein the quilt is easily convertible between an opened configuration and a closed configuration.

BACKGROUND

Conventional sleeping bags include rectangular sleeping bags, semi-rectangular sleeping bags, and mummy-type sleeping bags. Larger bags are often more comfortable and allow more freedom of movement, and smaller bags are typically more thermally efficient due to a smaller interior volume that is heated by a user's body. The user therefore has to compromise or acquire multiple different bags suitable for different temperature and climate conditions; given conventional sleeping bag are not readily adaptable to even a moderate range of temperature and climate conditions. Furthermore, even with larger sleeping bag being suitable for the particular temperature and climate conditions, a sleeping bag is nevertheless more restrictive and less comfortable relative to traditional bedding, and the sleeping bag does not readily accommodate various sleeping positions.

Unlike conventional sleeping bags, quilts are commonly a rectangular covering adapted to keep a user warm, especially while sleeping by laying the quit over the user. While many quilts are intended for indoor use, quilts can also be used in the outdoors by backpackers, hikers, campers, mountaineers, and other users as portable bedding or coverings. Outdoor quilts are often durable, soft, thermally insulated for a particular temperature and climate rating, and weather resistant. Outdoor users commonly prefer quilts over conventional sleeping bags because quilts tend to be lighter in weight/volume and more comfortable. By way of example, quilts are substantially less restrictive during use than a conventional sleeping bag (e.g., a mummy bag).

Conventional quilts, however, do not include means for easily converting the quilt from an opened configuration wherein the width of the quilt is maximized to a closed configuration wherein the quilt is generally in the form of a mummy sleeping bag. As a result, conventional quilts are susceptible to drafts and allowing heat to escape from around the user's body. Thus, conventional quilts provide limited warmth for some users in cooler temperatures.

Accordingly, a need exists for a quilt that can selectively converted from an opened configuration to a closed configuration.

SUMMARY

In one aspect, a quilt generally comprises a top edge, a first lateral edge, a second lateral edge spaced from the first lateral edge, a bottom edge, a bottom corner of the first lateral edge, and a bottom corner of the second lateral edge. The second lateral edge crosses the first lateral edge. The first lateral edge and the second lateral edge are connected to or adjacent to the bottom edge.

In another aspect, a quilt generally comprises an inner surface, an outer surface opposed to the inner surface, a top edge, a bottom edge, a first lateral edge, and a second lateral edge spaced from the first lateral edge. A bottom corner of the first lateral edge is in overlapping relationship with a bottom corner of the second lateral edge adjacent the bottom edge. At least one first lateral fastener element extends along the first lateral edge and at least one second lateral fastener element extends along the second lateral edge. The first at least one lateral fastener element is adapted for selective engagement and disengagement with the second at least one lateral fastener element to selectively move the quilt between an opened configuration and a closed configuration of the quilt.

In yet another aspect, a zipper-less quilt generally comprises an inner surface, an outer surface opposed to the inner surface, a top edge, a bottom edge, a first lateral edge, and a second lateral edge spaced from the first lateral edge. A bottom corner of the first lateral edge is attached to or adjacent the bottom edge. A bottom corner of the second lateral edge is attached to or adjacent the bottom edge such that the first lateral edge crosses the second lateral edges. At least one first lateral fastener element extends along the first lateral edge and at least one second lateral fastener element extends along the second lateral edge. The first at least one lateral fastener element is adapted for selective engagement and disengagement with the second at least one lateral fastener element to selectively move the quilt between an opened configuration and a closed configuration of the quilt.

Objects and advantages pertaining to the quilt disclosure herein may become apparent upon referring to the example embodiments illustrated in the drawings and disclosed in the following written description and/or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The embodiments depicted are shown only schematically; all features may not be shown in full detail or in proper proportion, certain features or structures may be exaggerated relative to others for clarity, and the drawings should not be regarded as being to scale. The embodiments shown are only examples, and should not be construed as limiting the scope of the present disclosure or appended claims.

DETAILED DESCRIPTION OF EMBODIMENTS

"Discrete" fastener elements as used in the present disclosure are to be contrasted with "continuous" fastener elements. A continuous fastener element attaches together different portions of a quilt or a sheet along a continuous line of attachment, leaving no significant gaps along that line of attachment. Examples of continuous fastener elements include but are not limited to, e.g., mating halves of a zipper, mating strips of hook material and loop material of a hook-and-loop fastener (e.g., Velcro®), or strips of magnetic plastic (e.g., such as is used for refrigerator magnets). Discrete fastener elements attach together different portions of a quilt or sheet at only localized attachment points or areas along an attachment path, leaving gaps between those localized attachment points or areas. Examples of discrete fastener elements include but are not limited to, e.g., a cord loop and a hook to retain the cord loop, mating male and female snap elements, mating button and buttonhole, mating male and female buckle or clasp elements, mating circumscribed patches of hook material and loop material of a hook-and-loop material, or pairs of magnets. Unlike hook-and-loop material (e.g., Velcro®) that includes myriad tiny loops and tiny hooks arranged on strips or patches, a single cord loop and hook are arranged to engage and retain the cord loop.

In accompanying drawings showing all or portions of a quilt or sheet, fastener elements of a mating or corresponding pair are indicated by an "X" for one fastener element (e.g., a hook) and an "0" for the other fastener element (e.g., a cord loop). It is not intended that every "X" or that every "0" in a given drawing necessarily indicates the same type of fastener element, although that can sometimes be the case.

Figure 1:
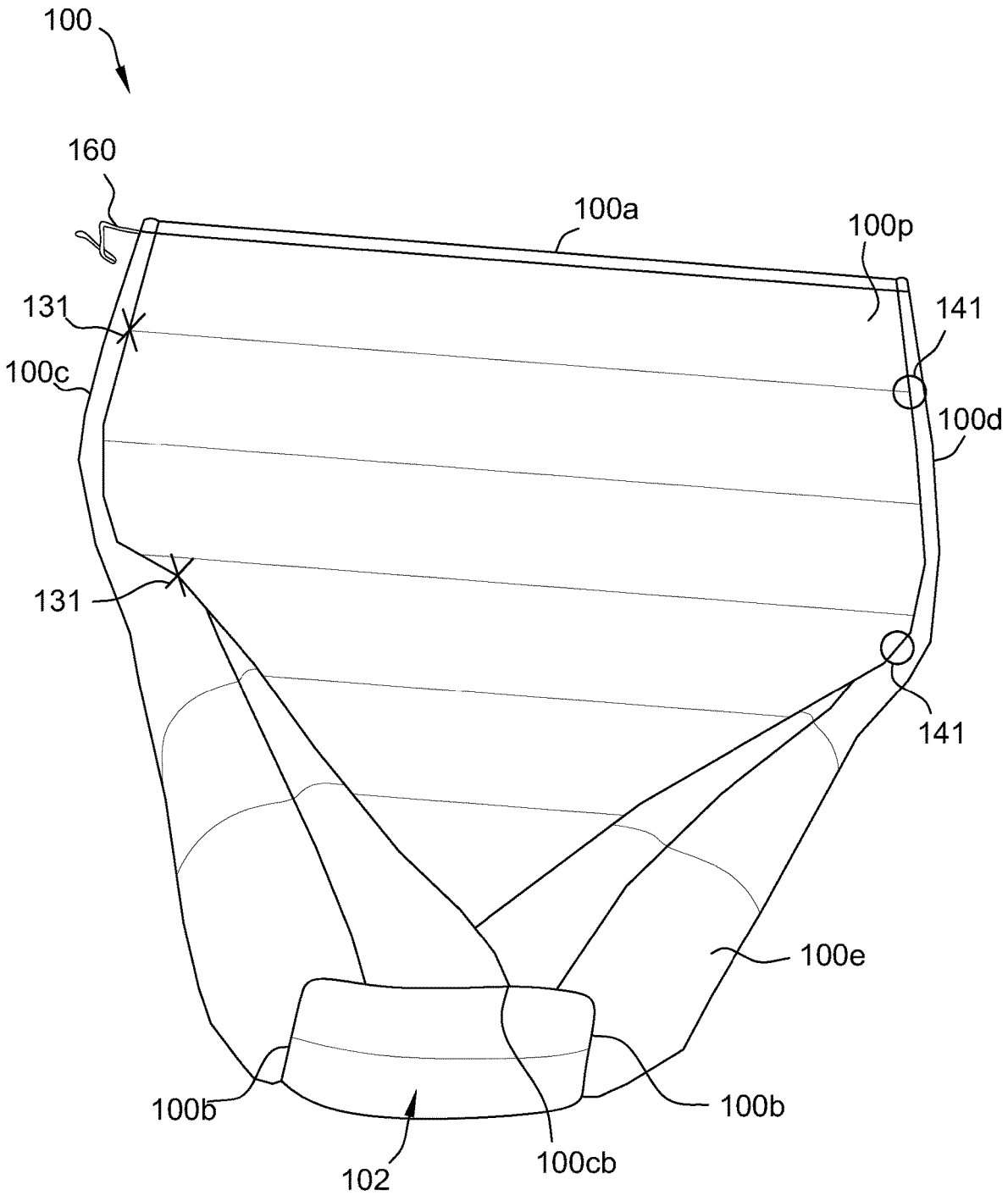
FIG. 1 is a perspective view of one suitable embodiment of a quilt have a footbox in accordance with the present disclosure, an inner surface of the quilt being shown.
Figure 2:
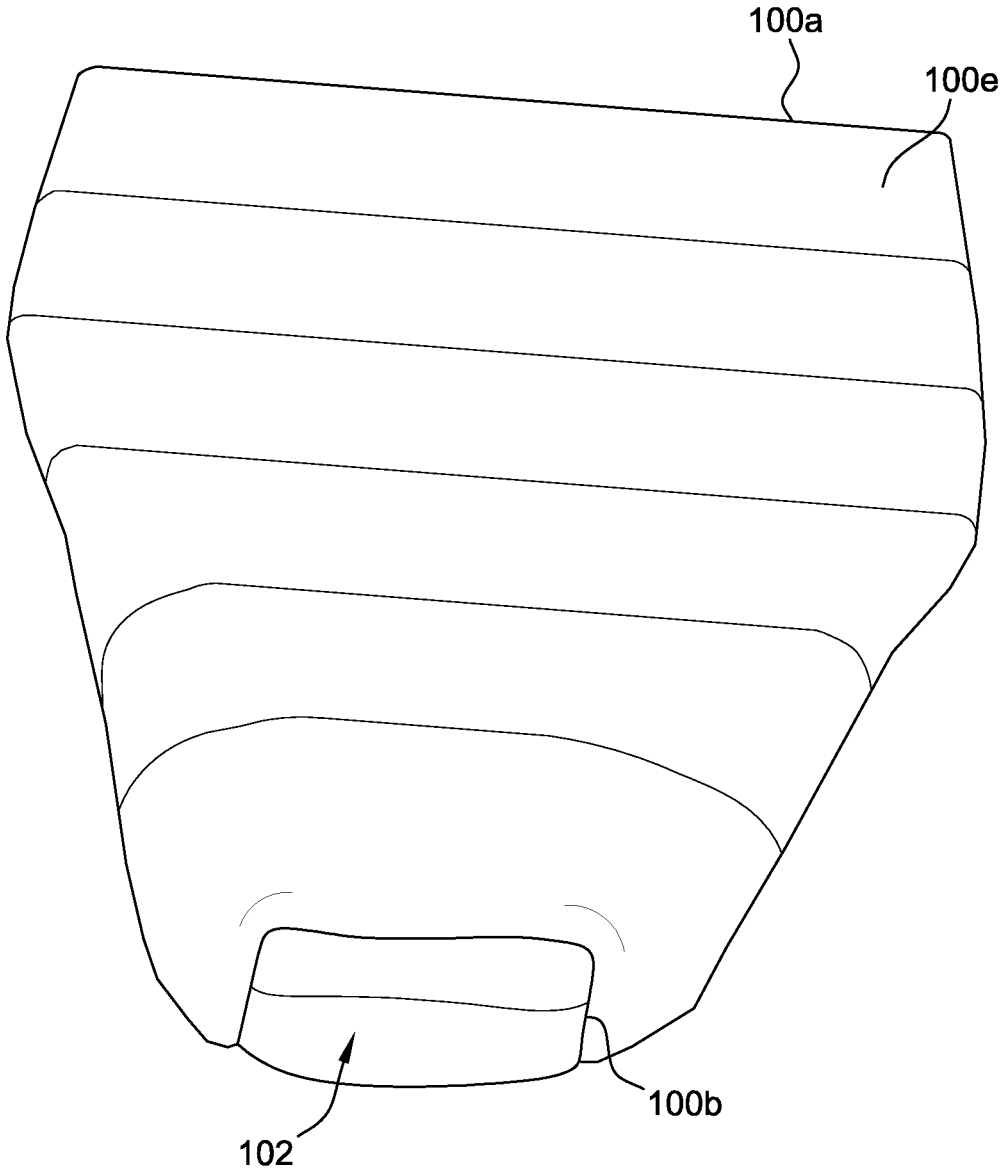
FIG. 2 is a perspective view of the quilt of FIG. 1 showing its outer surface, the footbox being in an opened configuration.

With reference now to FIGS. 1 and 2, a quilt, indicated generally at 100, includes a headward top edge 100*a*, a first lateral edge 100*c*, a second lateral edge 100*d*, an outer surface 100*e* (FIG. 2), and an inner surface 100*f* (FIG. 1). In one suitable embodiment, the quilt 100 includes a quilted construction, i.e., two layers of fabric with some soft substance (e.g., wool, down, or other natural or synthetic insulation) between the two layers and stitched in patterns or tufted through all thicknesses in order to prevent the filling from shifting (horizontal extending lines in the drawings indicate stitching). The term "quilt" is used generically herein to indicate any quilt-like or blanket-like article suitable for use as all or part of a sleeping article. Thus, use of the term "quilt" is not intended to imply that the article so named must necessarily include quilting or be wholly or partly quilted, although such articles are encompassed by the term "quilt" as employed herein. The quilt 100 can be made in any suitable way from any one or more suitable materials. Any one or more materials (e.g., fabrics or insulators) suitable for constructing a conventional quilt can be employed for constructing the quilt 100 disclosed herein. Examples of such materials include, but are not limited to: nylon, polyester, silk, cotton, taffeta, ripstop, pongee, flannel, microfiber, Gore-Tex, or fleece; natural down, synthetic insulation, or other insulating material; or metal-coated polymer film or other thermally shielding or thermally reflective material. If needed or desired, the quilt can include heating elements, e.g., electrical or chemical heating elements.

Figure 6:
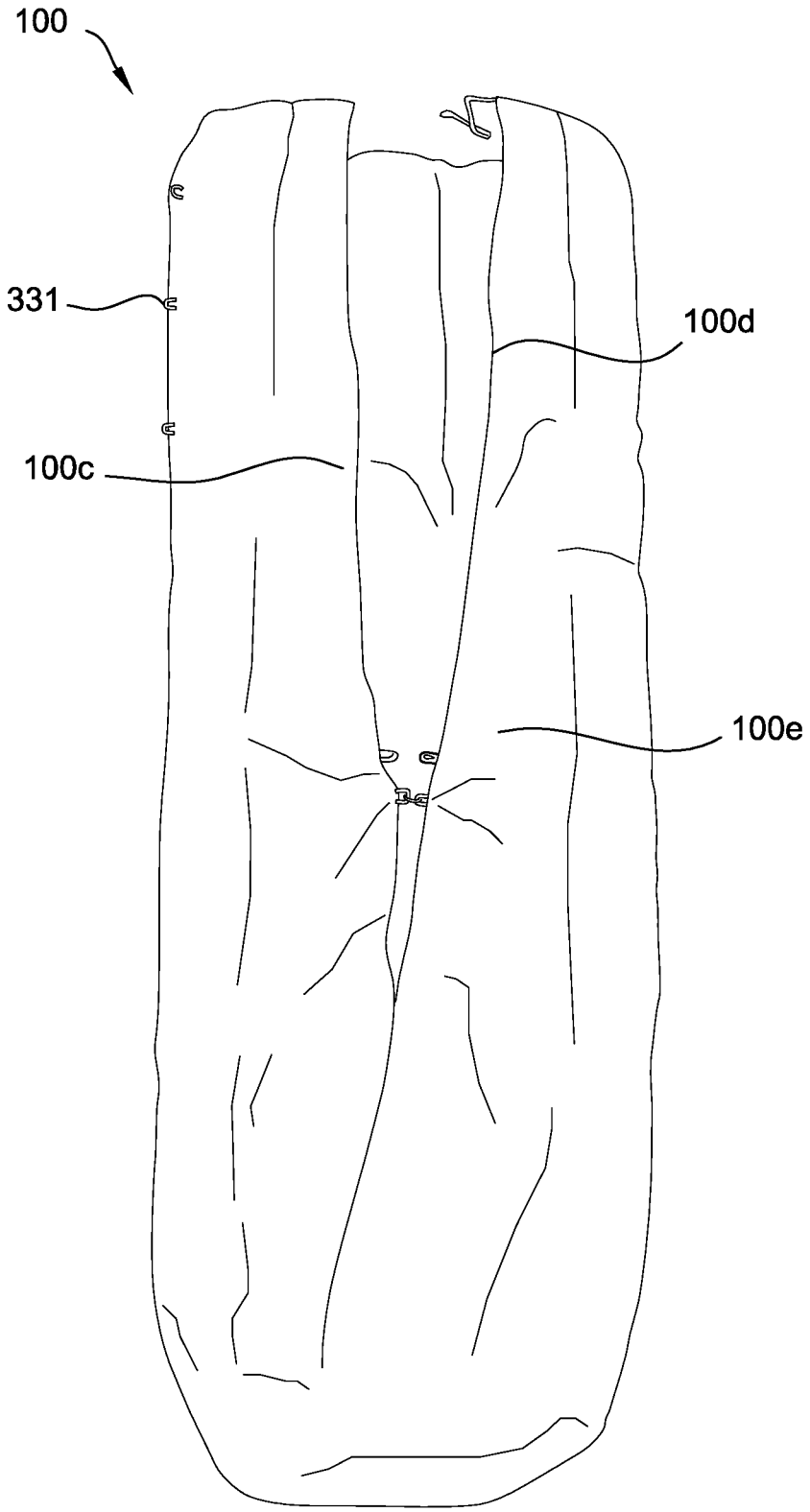

As illustrated in FIG. 1, the quilt 100 includes a first set of one or more lateral fastener elements 131 extending along the first lateral edge 100*c* and a second set of one or more lateral fastener elements 141 extending along the second lateral edge 100*d*, and in some embodiments, a draw cord 160. In the illustrated embodiment, the quilt 100 includes two first lateral fastener elements 131 disposed along the first lateral edge 100*c* and two associated second lateral fastener elements 141 disposed along the second lateral edge 100*d*. It is contemplated, however, that any suitable number of first lateral fastener elements 131 can be disposed along the first lateral edge 100*c* and any suitable number of second lateral fastener elements 141 can be disposed along the second lateral edge 100*d*. The first set of one or more lateral fastener elements 131 and the second set of one or more lateral fastener elements 141 are adapted for selective engagement and disengagement with each other to arrange the quilt from an opened configuration (FIGS. 1 and 2) to a closed configuration (FIG. 6). In the opened configuration, the quilt 100 is adapted to be extended to its widest possible width and, in the closed configuration, the quilt is generally adapted to be in a mummy like configuration.

The discrete lateral fastener elements 131, 141 can be of any suitable type of fastener or have any suitable arrangement, including those described above (e.g., a cord loop and a hook, mating male and female snap elements, mating button and buttonhole, mating male and female buckle or clasp elements, mating circumscribed patches of hook material and loop material of a hook-and-loop material, or pairs of magnets).

With reference again to FIGS. 1 and 2, a footward portion of the quilt 100 includes a bottom edge 100*b* that is wrapped around and sewn or otherwise connected to a footbox base 102 forming an overlapping footbox. In the illustrated configuration, the footbox base 102 is rectangular and, as a result, the bottom edge 100*b* is also rectangular. It is understood, however, that the footbox base 102 and bottom edge 100*b* can have any suitable shapes without departing from some aspects of this disclosure.

As best seen in FIG. 1, a bottom corner 100*cb* of the first lateral edge 100*c* is located beyond a bottom corner (not shown) of the second lateral edge 100*d* to define an overlapping area in the footward portion of the quilt 100. In the illustrated embodiment, the overlapping area is generally triangular. The bottom corner 100*cb* of the first lateral edge 100*c* and the bottom corner (not shown) of the second lateral edge 100*d* are sewn or otherwise connected to the footbox base 102 at the bottom edge 100*b*. Stated differently, the first lateral edge 100*c* crosses over the second lateral edge 100*d* adjacent the footbox base 102.

With reference now to FIG. 6, engagement of at least one of the first set of one or more lateral fastener elements 131 with an associated second set of one or more lateral fastener elements 141 retains the first lateral edge 100*c* and the second lateral edge 100*d* in the overlapping footbox arrangement with the bottom corner 100*cb* of the first lateral edge 100*c* and the bottom corner (not shown) of the second lateral edge 100*d* crossing each other. The footbox base 102 as illustrated in FIGS. 1 and 2 is a flexible, fabric panel. In one suitable embodiment, the flexible, fabric panel is constructed substantially the same as the remainder of the quilt 100. It is contemplated that the footbox base 102 can be constructed of any suitable material that is the same or different that the remainder of the quilt.

In some embodiments, the draw cord 160 is disposed at or adjacent the headward top edge 100*a*. In some suitable embodiments, the draw cord 160 extends substantially entirely across the width of the headward top edge 100*a*. The draw cord 160 can be of any suitable or conventional type or arrangement. Pulling the draw cord 160 gathers the headward top edge 100*a* of the quilt 100 to at least partially close the quilt, and to retain heat of the user. Suitable draw cords and configurations of a quilt having a draw cord are disclosed in U.S. patent application Ser. No. 17/872,349 filed Jul. 25, 2022 entitled Adjustable Quilt, which is incorporated herein by reference is its entirety.

The closure arrangement described above for the footbox (or closed) configuration of the quilt 100 is used to quickly and easily move the quilt 100 between the opened configuration (FIGS. 1 and 2) to a closed configuration (FIG. 6) by engaging or disengaging at least one pair of the lateral fastener elements 131, 141. As mentioned above, the user can arrange the quilt 100 in the opened configuration to maximize the width of the quilt or can arrange the quilt 100 in the closed configuration to convert the quilt to a mummy configuration. Thus, the user can readily convert the quilt 100 between the opened or closed configurations or even stages between these two configurations if more than one pair of the lateral fastener elements 131, 141 are provided.

Weight is an important constraint in designing outdoor gear, particularly if that gear is to be carried by person traveling on foot over a significant distance (e.g., during a backpacking outing). Lightweight materials and specialized construction techniques have been developed over the years to produce ever lighter gear items such as tents and quilts. As weight limits are pressed lower and lower, finding ways to cut further weight becomes correspondingly more difficult. In so-called ultralight quilts, zippers c a n account for a significant percentage of the overall weight, in some cases about 10% to about 20% or even more. A zipper-less quilt arrangement, such as the one disclosed herein, eliminate that weight, thereby enabling further overall weight reduction of the quilt, or replacement of the zipper weight with, e.g., more or denser fill for enhancing the thermal performance of the quilt, or heavier cover material for improved durability.

Figure 3:
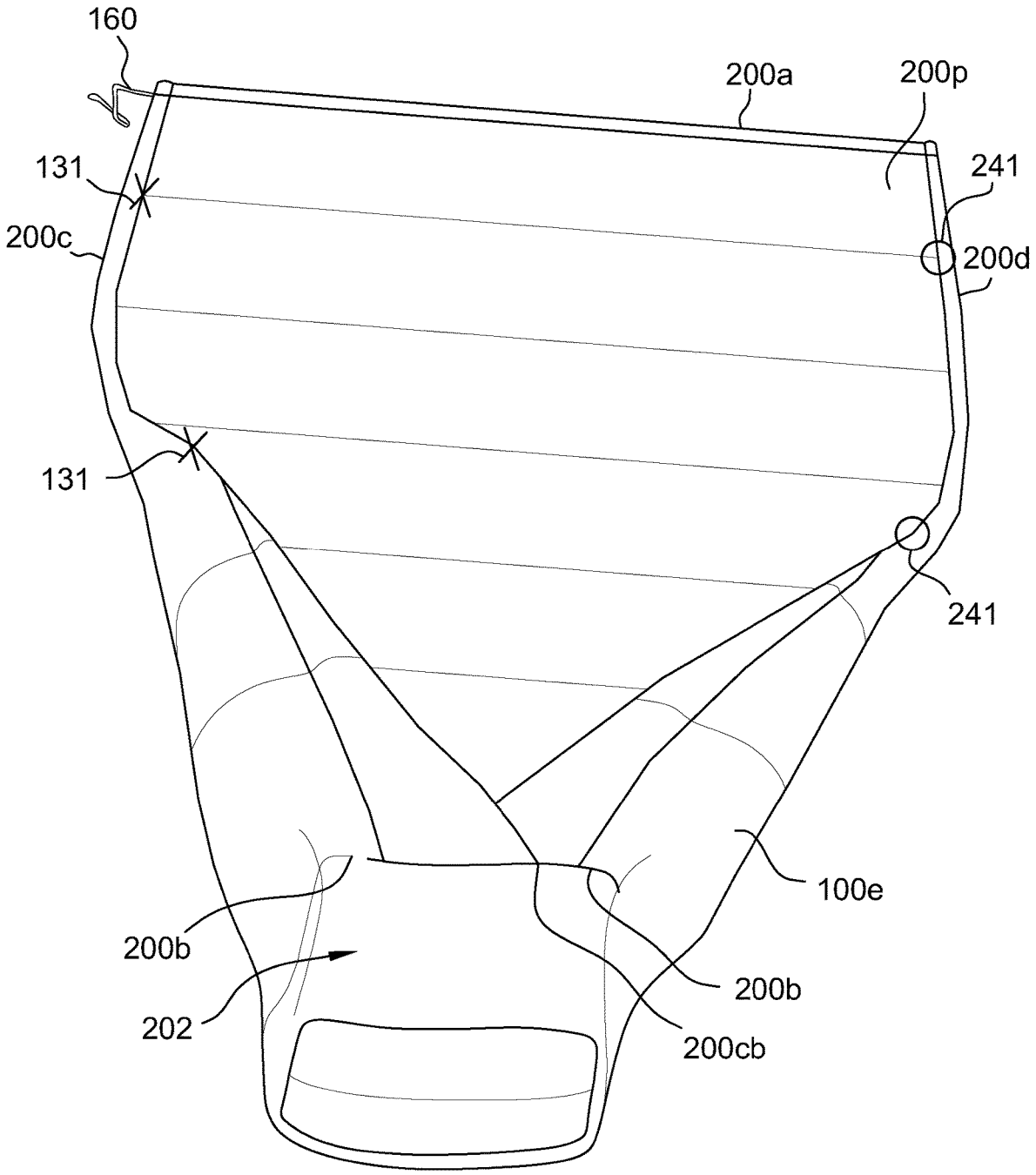
FIG. 3 is a perspective view of another suitable embodiment of a quilt in accordance with the present disclosure, an inner surface of the quilt being shown.
Figure 4:
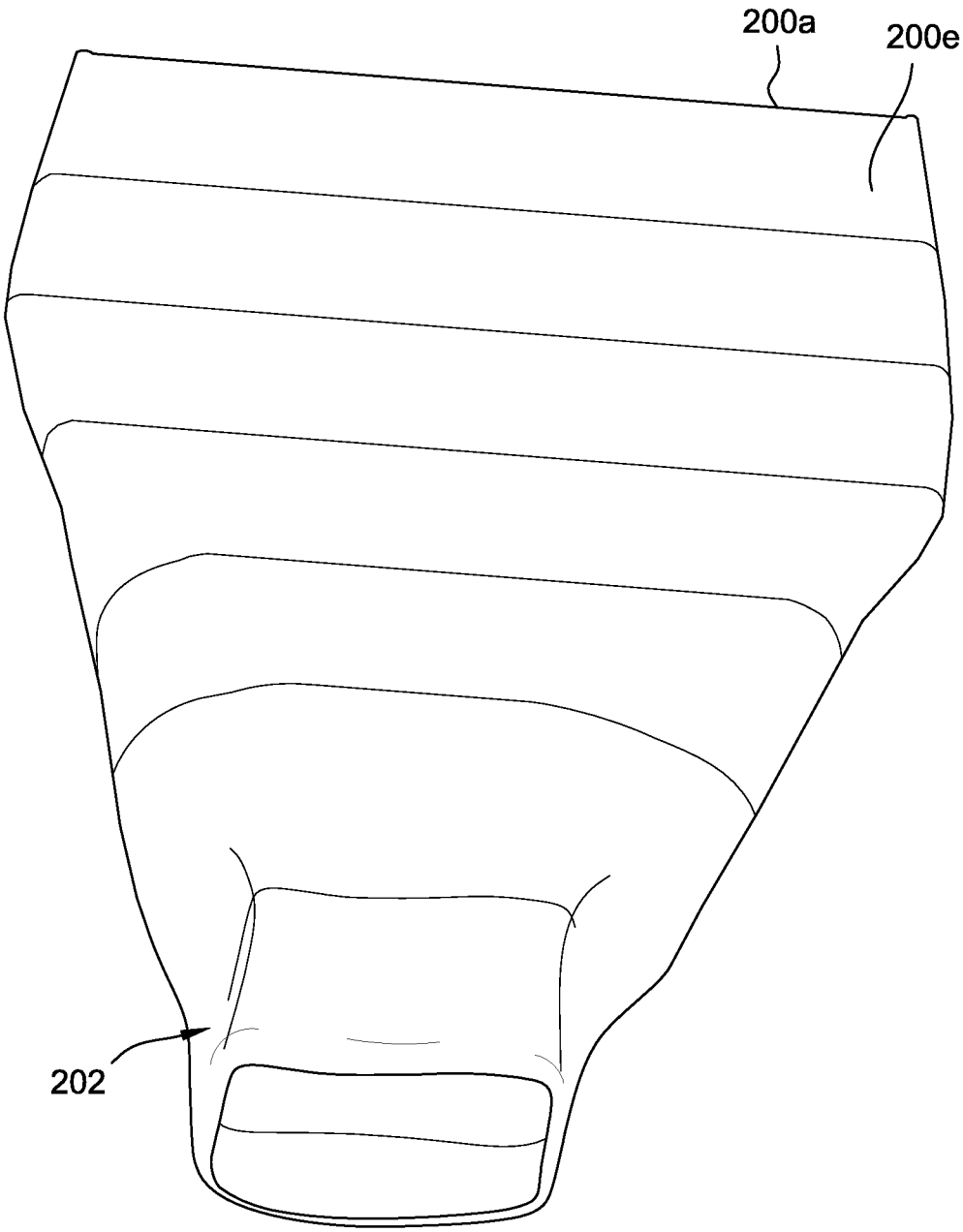
FIG. 4 is a perspective view of the quilt of FIG. 3 showing its outer surface, the footbox being in an opened configuration.
Figure 5:
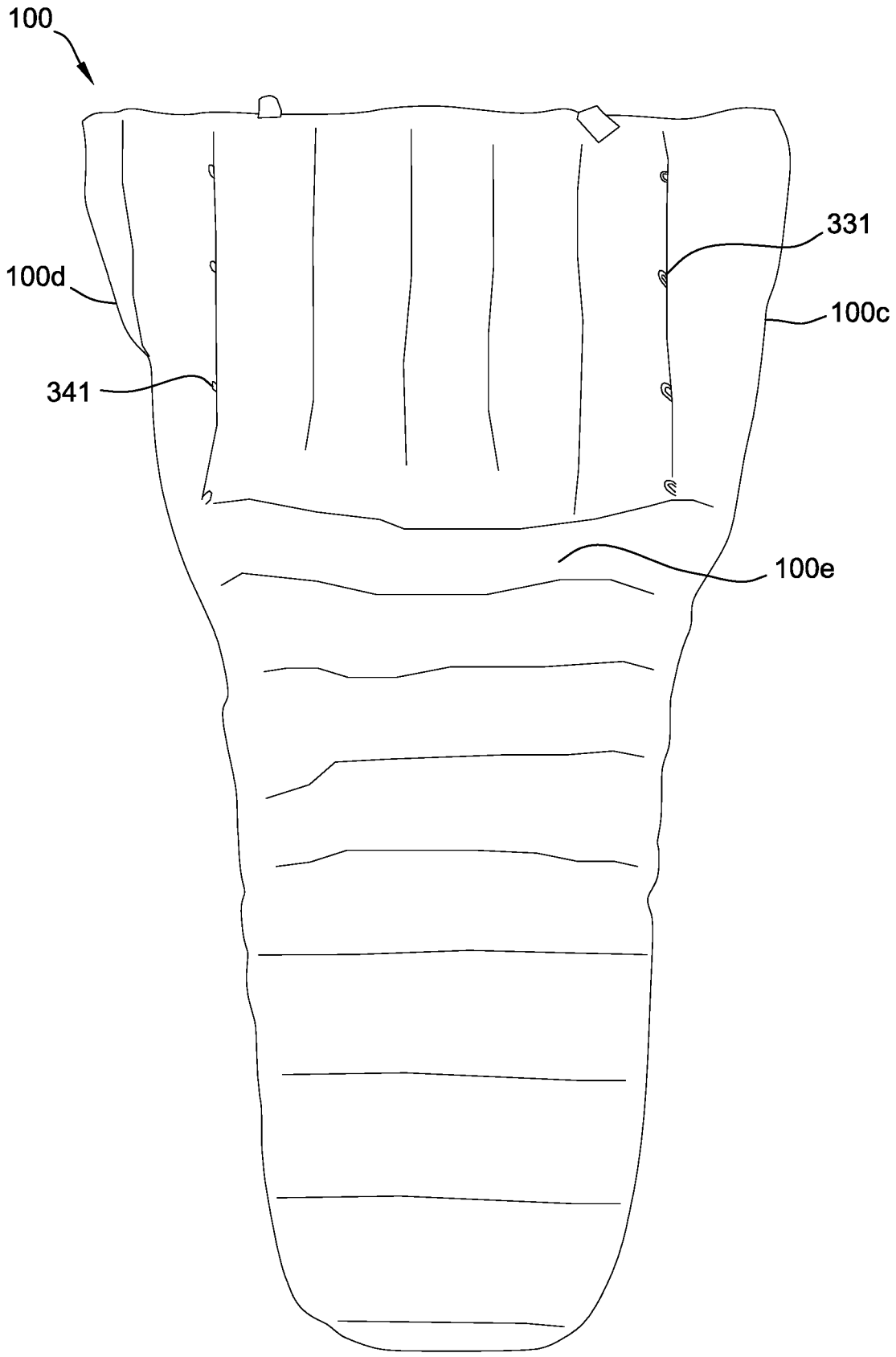
FIG. 5 is a perspective view of a quilt like the one shown in FIG. 1 showing its outer surface; and, FIG. 6 is a perspective view of the quilt of FIG. 5 with the footbox being in a closed configuration.

FIGS. 3 and 4 illustrate an alternative embodiment of a quilt 200 having an extended footbox box indicated generally at 202. The quilt 200 of FIGS. 3 and 4 operate in substantially the same manner as the quilt 100 of FIGS. 1 and 2 except for the extended footbox base 202. The extended footbox base 202 is an elongate extension of the quilt 200 having a trapezoidal or rectangular shape. Similar to the quilt 100 of FIGS. 1 and 2, a bottom edge 200*b* is wrapped around and sewn or otherwise connected to the extended footbox base 202 forming an overlapping footbox. As shown in FIG. 5, a first set of one or more lateral fastener elements 331 extend partially along a first longitudinal line on the outer surface 100*e* and a second set of one or more lateral fastener elements 341 extend partially along a second longitudinal line on the outer surface 100*e*.

It is contemplated that the quilt 100, 200 of the present disclosure can be used as a component in the sleeping bag assembly disclosed in U.S. Pat. No. 10,786,100 entitled Girth-Adjustable Sleeping Bag, which is hereby incorporated by reference in its entirety. In one suitable embodiment, the quilt 100, 200 can be used with a bottom sheet and a sleeping pad.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore, the present disclosure shall be construed as implicitly disclosing any embodiment having any suitable set of one or more features—which features are shown, described, or claimed in the present application—including those sets that may not be explicitly disclosed herein. A "suitable" set of features includes only features that are neither incompatible nor mutually exclusive with respect to any other feature of the set.

Accordingly, the appended claims are hereby incorporated into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the scope of the appended claims can, but does not necessarily, encompass the whole of the subject matter disclosed in the present application.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A quilt comprising a top edge, a first lateral edge, a second lateral edge spaced from the first lateral edge, a bottom edge, a bottom corner of the first lateral edge, and a bottom corner of the second lateral edge crossing the first lateral edge, the bottom corner of the first lateral edge and the bottom corner of the second lateral edge being sewn to or adjacent to the bottom edge to define a triangular overlapping area.

2. The quilt of claim 1 further comprising at least one first lateral fastener element attached along the first lateral edge and at least one second lateral fastener element attached along the second lateral edge, the at least one first lateral fastener element being adapted for selective engagement and disengagement with the at least one second lateral fastener element.

3. The quilt of claim 2 wherein the at least one first lateral fastener element is adapted for selective engagement and disengagement with the at least one second lateral fastener element to move the quilt between a closed configuration and an opened configuration of the quilt.

4. The quilt of claim 2 wherein the at least one first lateral fastener element and the at least one second lateral fastener element are selected from a group consisting of a cord loop and a hook, mating male and female snap elements, mating button and buttonhole, mating male and female buckle or clasp elements, mating circumscribed patches of hook material and loop material of a hook-and-loop material, and pairs of magnets.

5. The quilt of claim 1 further comprising a draw cord extending across the top edge, the draw cord configured to cinch the top edge.

6. The quilt of claim 1 wherein the quilt is free of a continuous fastener.

7. A quilt comprises an inner surface, an outer surface opposed to the inner surface, a top edge, a bottom edge, a first lateral edge, and a second lateral edge spaced from the first lateral edge, a bottom corner of the first lateral edge, a bottom corner of the second lateral edge, the bottom corner of the first lateral edge being in overlapping relationship with the bottom corner of the second lateral edge adjacent the bottom edge to define a triangular overlapping area, at least one first lateral fastener element extending along the first lateral edge and at least one second lateral fastener element extending along the second lateral edge, the at least one first lateral fastener element being adapted for selective engagement and disengagement with the at least one second lateral fastener element to selectively move the quilt between an opened configuration of the quilt and a closed configuration of the quilt, the triangular overlapping area being present in both the opened configuration and the closed configuration of the quilt.

8. The quilt of claim 7 wherein the at least one first lateral fastener element and the at least one second lateral fastener element are selected from a group consisting of a cord loop and a hook, mating male and female snap elements, mating button and buttonhole, mating male and female buckle or clasp elements, mating circumscribed patches of hook material and loop material of a hook-and-loop material, and pairs of magnets.

9. The quilt of claim 7 further comprising an inner layer, an outer layer, and fill sandwiched between the inner layer and the outer layer.

10. The quilt of claim 7 wherein the at least one first lateral fastener element is a single first lateral fastener element, and the at least one second lateral fastener element is a single second lateral fastener element.

11. The quilt of claim 7 further comprising a footward portion including a footbox base and the bottom edge, the bottom edge connecting the footbox base to the quilt.

12. The quilt of claim 7 further comprising a draw cord disposed at or adjacent the top edge.

13. The quilt of claim 12 wherein the draw cord is adapted to cinch the quilt at or near the top edge.

14. The quilt of claim 7 further comprising an extended footbox.

15. A zipper-less quilt comprises an inner surface, an outer surface opposed to the inner surface, a top edge, a bottom edge, a first lateral edge, and a second lateral edge spaced from the first lateral edge, a bottom corner of the first lateral edge being attached to or adjacent the bottom edge, a bottom corner of the second lateral edge being attached to or adjacent the bottom edge such that the first lateral edge crosses the second lateral edge to define a triangular overlapping area, at least one first lateral fastener element extending along the first lateral edge and at least one second lateral fastener element extending along the second lateral edge, the at least one first lateral fastener element being adapted for selective engagement and disengagement with the at least one second lateral fastener element to selectively move the quilt between an opened configuration and a closed configuration of the quilt, the triangular overlapping area being present in both the opened configuration and the closed configuration of the quilt.

16. The quilt of claim 15 further comprising an inner layer, an outer layer, and fill sandwiched between the inner layer and the outer layer.

17. The quilt of claim 15 wherein the at least one first lateral fastener element is a single first lateral fastener element, and the at least one second lateral fastener element is a single second lateral fastener element.

18. The quilt of claim 15 further comprising a footward portion including a footbox base and the bottom edge, the bottom edge connecting the footbox base to the quilt.

19. The quilt of claim 15 further comprising a draw cord disposed at or adjacent the top edge.

20. The quilt of claim 15 further comprising an extended footbox.

* * * * *